US011331699B2

(12) United States Patent
Baek

(10) Patent No.: US 11,331,699 B2
(45) Date of Patent: May 17, 2022

(54) PIPE CLEANING ROBOTIC DEVICE FOR SLUDGE REMOVAL, SUCTION AND DISCHARGE

(71) Applicant: DAHEUNG ENG CO., LTD., Busan (KR)

(72) Inventor: Soung Lyong Baek, Busan (KR)

(73) Assignee: DAHEUNG ENG CO., LTD., Busan (KR)

( * ) Notice: Subject to any disclaimer, the term of this patent is extended or adjusted under 35 U.S.C. 154(b) by 436 days.

(21) Appl. No.: 16/540,057

(22) Filed: Aug. 14, 2019

(65) Prior Publication Data

US 2020/0230668 A1 Jul. 23, 2020

(30) Foreign Application Priority Data

Jan. 23, 2019 (KR) ..... 10-2019-0008669

(51) Int. Cl.

| | |
|---|---|
| ***B08B 13/00*** | (2006.01) |
| ***B08B 9/051*** | (2006.01) |
| ***B08B 7/04*** | (2006.01) |
| ***B08B 7/02*** | (2006.01) |

(52) U.S. Cl.

CPC ..... *B08B 9/051* (2013.01); *B08B 7/026* (2013.01); *B08B 7/04* (2013.01)

(58) Field of Classification Search

None

See application file for complete search history.

(56) References Cited

U.S. PATENT DOCUMENTS 5,362,962 A * 11/1994 Barborak ..... E21B 23/00 250/234

FOREIGN PATENT DOCUMENTS

| | | |
|---|---|---|
| KR | 101373301 B1 | 3/2014 |
| KR | 101688518 B1 | 1/2017 |

* cited by examiner

*Primary Examiner* — Eric W Golightly

(74) *Attorney, Agent, or Firm* — Bayramoglu Law Offices LLC

(57) ABSTRACT

A pipe cleaning robotic device for sludge removal and suction and discharge includes a rail having a plurality of receiving grooves spaced at a predetermined distance on one side thereof; a fixed unit formed at an end of the rail, inserted into a pipe, and fixed in contact with an inner peripheral surface of the pipe; a driving unit mounted on the rail and movable in forward and backward directions along the rail by a wheel drive rotated by an external power; a cylindrical frame for moving and rotating in the forward and backward directions according to driving of the wheel drive; and a sound wave generator formed on one side of an outer circumference of the frame to generate a sound wave to remove the sludge in the pipe cleaning robotic device.

4 Claims, 3 Drawing Sheets

PIPE CLEANING ROBOTIC DEVICE FOR SLUDGE REMOVAL, SUCTION AND DISCHARGE

CROSS REFERENCE TO THE RELATED APPLICATIONS

This application is based upon and claims priority to Patent Application No. KR 10-2019-0008669 filed on Jan. 23, 2019 in Republic of Korea, the entire contents of which are incorporated herein by reference.

TECHNICAL FIELD

The present invention relates to a pipe cleaning robotic device for sludge removal and suction and discharge, and more specifically to a pipe cleaning robotic device that can move into a pipe and dissipate sound waves to disperse and remove sludge inside the pipe, and suck and discharge the dispersed sludge to the outside.

BACKGROUND

Generally, fluid flows for a long time inside pipe installed in various facilities. Due to the nature of the fluid, sludge, scale, microorganism, chemical substance or marine life are attached to the pipe.

Then, the inner diameter of the pipe becomes smaller due to sludge or the like attached to the inner wall of the pipe, resulting in insufficient flow rate, hazardous substances in waterworks, and low thermal efficiency and shortened life in boilers and the like.

Accordingly, conventionally, high pressure air, water, sand or the like has been sprayed or chemical substances have been used to remove the sludge fixed inside the pipe.

As related arts related thereto, Korean Patent No. 10-1373301 and Korean Patent No. 10-1688518 are disclosed.

However, the conventional working apparatus described above has a considerable difficulty in entering a pipe having a sludge of 10% or more inside the pipe or a pipe having a non-constant diameter, and also lacks sludge suction capacity as it needs to increase the output of the suction pump to discharge the removed sludge to the outside in a long pipe.

SUMMARY

The present invention has been made to solve the above problems, and has a purpose to provide a pipe cleaning robotic device for sludge removal and suction and discharge, which can smoothly enter a pipe with improved ability to suck dispersed sludge, regardless of the sludge fixed state inside the pipe or the inside diameter of the pipe.

The present invention comprises: a rail having a plurality of receiving grooves spaced at a predetermined distance on one side thereof; a fixed unit formed at an end of the rail, inserted into the pipe, and fixed in close contact with the inner peripheral surface of the pipe; a driving unit mounted on the rail and movable in the forward and backward directions along the rail by a wheel drive rotated by an external power; a cylindrical frame capable of moving and rotating in forward and backward directions according to wheel drive driving; a sound wave generator formed on one side of the outer circumference of the frame to generate a sound wave to remove a sludge in the pipe; a rotary brush detachably formed on the other side of the outer circumferential surface of the frame and having an elastic material brush pin formed on the outer circumferential surface thereof; a cleaning unit mounted on a rear side of the fixed unit; a funnel-shaped inlet having upper and lower openings, wherein the upper opening diameter is larger than the diameter of the frame; a bellows-shaped suction line formed on the rear side of the inlet; and a suction unit mounted on the rear side of the cleaning unit and spaced apart by a predetermined space, wherein the suction unit sucks the sludge falling into the space and collects the sludge in the inner space of the inlet, and discharges the sludge to the outside through the suction line connected to the inlet.

Preferably, the fixed unit comprises: a head portion having a plurality of through-grooves formed at a front side thereof and spaced apart from each other by a predetermined distance; a cover which is housed in an inner space of the head portion and is coupled to a push rod which is horizontally movable forward and backward according to air pressure; a pressure control valve installed on the cover to regulate air pressure in the internal space; a plurality of supports which are provided being inclined at an angle to be disposed radially above the cover for inserting one side thereof into the through-groove; and a guide wheel formed at an end of the support.

In addition, preferably, the driving unit further comprises: a wheel drive including a worm wheel and a worm shaft to be engaged with the worm wheel and rotated by external power; a forward drive that is mounted on the worm wheel, rotates according to worm wheel rotation, with a gear engaged with receiving groove during rotation, and is capable of moving in the forward and backward directions of the rail depending on the rotation direction; and a rotation drive mounted on one side of the worm shaft and rotating according to rotation of the worm shaft, wherein an internal gear that is formed on one side of the inner circumferential surface of the frame and rotates being engaged with the gear formed on the rotation drive.

In addition, preferably, the inlet and the frame are provided with a plurality of guide wheels spaced apart in the circumferential direction along the outer circumferential surface.

The pipe cleaning robotic device for sludge removal and suction and discharge according to the present invention comprises a fixed unit which is inserted into a pipe and has a variable shape corresponding to the diameter of the inner circumference of the pipe, making it possible to smoothly enter the pipe regardless of the state of the sludge fixed inside the pipe or the inside diameter of the pipe.

In addition, the device is configured to suck the sludge falling into the space between the cleaning unit and the suction unit and to discharge the sludge to the outside through the suction line connected to the pump, improving suction ability and energy consumption rate without requiring a high suction force.

DESCRIPTION OF SYMBOLS

Figure 1:
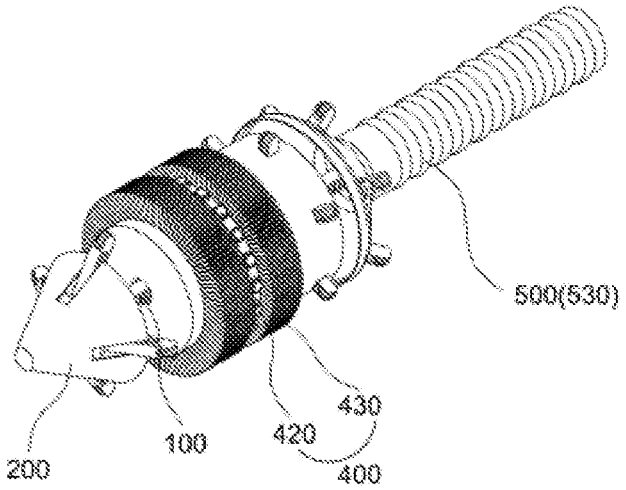
FIG. 1 is a perspective view of a pipe cleaning robotic device for sludge removal and suction and discharge according to an embodiment of the present invention.

1: pipe
2: sludge
100: rail
110: receiving groove
200: fixed unit
210: head portion
211: through-groove
230: cover
250: pressure control valve
270: support
271: guide wheel
300: driving unit
310: wheel drive
311: worm wheel
313: worm shaft
330: forward drive
350: rotation drive
400: cleaning unit
410: frame
411: internal gear
413: guide wheel
420: sound wave generator
430: rotary brush
500: suction unit
510: inlet
530: suction line
550: guide wheel

DETAILED DESCRIPTION OF THE EMBODIMENTS

Hereinafter, preferred embodiments of the present invention will be described in detail with reference to the accompanying drawings.

The pipe cleaning robotic device for sludge removal and suction and discharge according to the present invention is configured to enter a wet or dry pipe and emit a strong sound wave to disperse and remove sludge attached to the inside of the pipe, and to suck and discharge dispersed sludge and foreign matter to the outside.

Hereinafter, the configuration of a pipe cleaning robotic device for sludge removal and suction and discharge according to the present invention will be described in detail with reference to FIG. 1.

FIG. 1 is a perspective view of a pipe cleaning robotic device for sludge removal and suction and discharge according to an embodiment of the present invention.

As shown in FIG. 1, the pipe cleaning robotic device for sludge removal and suction and discharge according to the present invention includes a rail (100), a fixed unit (200), a driving unit (300), a cleaning unit (400), and a suction unit (500).

That is, according to the present invention, a rail (100) and a fixed unit (200), which can move freely within a wet or dry pipe, are installed in a pipe, and a cleaning unit (400) is configured to move within the pipe along the rail (100) by the force of the driving unit (300) mounted on the rail (100).

Accordingly, while the cleaning unit (400) moves inside the pipe, the sound wave generator (420) generates sound waves to decompose the sludge on the inner wall of the pipe and the rotary brush (430) finally removes the decomposed sludge. Then the removed sludge is dropped into the suction unit (500) and discharged to the outside through a suction line (530) connected to the pump.

First, the rail (100) and the fixed unit (200) will be described in detail with reference to FIG. 2.

Figure 2:
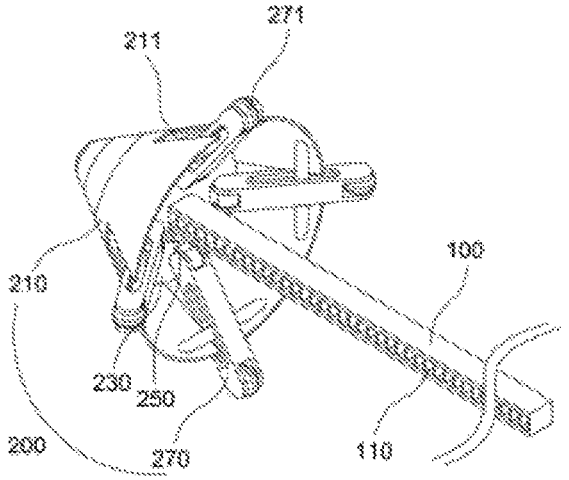
FIG. 2 is a perspective view of a rail and a fixed unit according to one embodiment of the present invention.

FIG. 2 is a perspective view of a rail (100) and a fixed unit (200) according to one embodiment of the present invention.

As shown in FIG. 2, the rail (100) has a plurality of receiving grooves (110) formed at one side thereof, being spaced apart from each other by a predetermined distance, and is installed inside the pipe. The rail (100) serves to guide the driving unit (300) and the cleaning unit (400), which will be described later, to move along the rail (100) in the forward and backward directions.

The fixed unit (200) is formed at the end of the rail (100) and is inserted into the pipe to be closely fixed to the inner circumference of the pipe. Specifically, the fixed unit (200) includes a head portion (210), a cover (230), a pressure control valve (250), a support (270) and a guide wheel (271).

Hereinafter, the configuration of the fixed unit (200) will be described in detail.

First, the head portion (210) is provided at a front side of the fixed unit (200), with a plurality of through-grooves (211) spaced at a predetermined interval.

The cover (230) is housed in an internal space of the head portion (210) and is coupled to a push rod (not shown) which is horizontally movable forward and rearward according to air pressure.

That is, the cover (230) is coupled with the push rod and is configured to move horizontally by a predetermined distance according to the operation of the push rod.

The pressure control valve (250) is installed on the cover (230) to adjust the air pressure of the internal space. The push rod and the cover move horizontally according to the driving of the pressure control valve (250).

The support (270) is radially disposed on the cover (230) so that one side of the support (270) is inserted into the through-groove (211), being inclined at a predetermined angle. Preferably, the support (270) is formed in a plurality of positions and numbers corresponding to the through-grooves (211).

In addition, as one side of the support (270) is inserted into the through-groove (211), its end may protrudes outward from the head portion (210), with protruding length varying depending on the receiving position in the head portion (210) of the cover (230).

The guide wheel (271) is formed at the end of the support (270) and is rotatable in the up and down direction to provide smooth movement of the fixed unit (200) from the inner wall of the pipe.

In addition, the guide wheel (271) is preferably formed of an elastic material so as to be elastically supported on the inner circumference of the pipe.

So far the detailed configuration of the fixed unit (200) has been described.

Preferably, the fixed unit (200) is introduced into the pipe by a separate hydraulic device (not shown) for imparting horizontal mobility.

The fixed unit (200) having the above-described detailed structure enters a pipe with an end of the support (270) protruding at least outward from the head portion (210) so as not to hit the inner wall of the pipe.

In addition, when entering the pipe, the fixed unit (200) can be balanced by a plurality of supports (270) spaced apart from each other by a predetermined distance. As a result, the fixed unit is prevented from being tilted in one side of the pipe so it can reach the forward target point stably, minimizing collision with the wall of the pipe.

That is, the fixed unit (200) can advance smoothly into the pipe by using the hydraulic pressure of the hydraulic device. When the fixed unit reaches the target point, the pressure control valve (250) is opened with the increase of pressure, causing a horizontal movement of the push rod and the cover (230) to a predetermined distance to the rear side.

Accordingly, the end of the support (270) protrudes to correspond to the inside diameter of the pipe. At this time, the fixed unit (200) is firmly fixed to the inside of the pipe while the guide wheel (271) is in close contact with the inner surface of the pipe.

Thus, the description of the fixed unit (200) is completed. Hereinafter, the driving unit (300) and the cleaning unit (400) will be described in detail with reference to FIG. 3.

Figure 3:
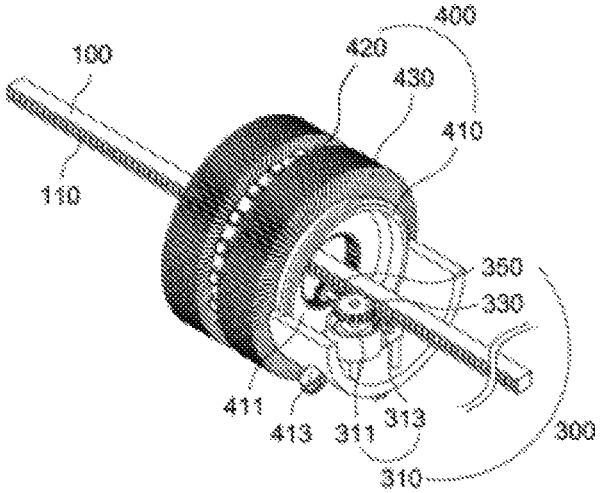
FIG. 3 is a perspective view of a driving unit and a cleaning unit according to an embodiment of the present invention.

FIG. 3 is a perspective view of a driving unit (300) and a cleaning unit (400) according to an embodiment of the present invention.

As shown in FIG. 3, the driving unit (300) is mounted on the rail (100) and can move in the forward and backward directions along the rail (100) by means of a wheel drive (310) rotated by an external power. Specifically, the driving unit includes a wheel drive (310), a forward drive (330), and a rotation drive (350).

The wheel drive (310) comprises a worm wheel (311) and a worm shaft (313) to be engaged with the worm wheel (311) and rotated by external power. The wheel drive (310) can convert the linear motion into the rotational motion or the rotational motion into the linear motion. Since this is a conventional technique, detailed description thereof will be omitted.

The forward drive (330) is mounted on the upper part of the worm wheel (311) and rotates in accordance with the rotation of the worm wheel (311). The forward drive (330) rotates with gear engaged with the receiving groove (110) and can move in the forward and backward directions along the rail (100).

The rotation drive (350), which is installed on one side of the worm shaft (313) and rotates according to the rotation of the worm shaft (313), is engaged with the internal gear (411) formed on one side of the inner circumferential surface of the frame (410) of the cleaning unit (400) to be described later.

The cleaning unit (400), which is mounted on the rear side of the fixed unit (200) and is moved and rotated in the forward and backward directions along the rail (100) inside the pipe by the driving unit (300) to remove the sludge on the inner wall of the pipe, includes a frame (410), a sound wave generator (420), and a rotary brush (430).

First, the frame (410) is connected to the driving unit (300) so that the driving unit can move and rotate the frame in the forward and backward directions, and is formed into a cylindrical shape.

In addition, the frame (410) has a plurality of guide wheels (413) spaced apart in the circumferential direction along the outer circumferential surface of the frame in order to provide smooth mobility when the cleaning unit (400) enters the pipe.

In addition, an internal gear (411) is coupled to the inner periphery of the frame (410) to rotate being engaged with the gear formed on the rotation drive (350). The internal gear (411) rotates the frame (410).

The sound wave generator (420) is formed on one side of the outer surface of the frame (410) and generates a sound wave to remove the sludge in the pipe.

More specifically, the sludge attached to the inside of the pipe can be removed due to the mechanical vibration of the sound waves generated by the sound wave generator (420).

In the water to which sound waves are transmitted, air bubbles generally are generated in the fluid called bubbles by waves due to a fine flow, and these bubbles are destroyed by the resonance frequency applied to the bubbles, generating energy to scatter and disperse the sludge and lumps attached inside the pipe.

Particularly, the above-mentioned underwater sound wave can generate stronger energy amplification, so that the sludge inside the pipe can be removed even in the presence of water and oil in the pipe.

The rotary brush (430) is detachably formed on the other side of the outer circumferential surface of the frame (410) and is replaceable when worn. It is possible to select a rotary brush (430) suitable for the shape and size of the pipe or the state of the sludge fixed inside the pipe.

Preferably, the rotary brush (430) is formed in a band shape of an elastic material so that it can be easily attached and detached from the frame (410).

In addition, the rotary brush (430) may have a brush pin of a flexible elastic material, which is formed on the outer circumferential surface thereof to be rotationally rubbed against the inside of the pipe to remove the sludge.

That is, when inserted into the pipe, the brush pin changes its shape to suit the internal environment of the pipe, including the state of the sludge inside the pipe or the diameter and shape of the pipe, and is closely attached to the inner wall of the pipe to remove the sludge more efficiently.

In addition, preferably, the cross-sectional shape or the cross-sectional area of each brush pin may be asymmetric or non-uniform in size and height, so that it can be made to fit in various environments inside the pipe.

In addition, preferably, the rotary brush (430) is formed on the front and rear sides of the sound wave generator (420).

That is, a rotary brush (430) is formed on the front side of the sound wave generator (420) and rotationally rubbed along the inner wall of the pipe to primarily remove the sludge.

Then, the sound wave generator (420) generates sound waves to decompose the sludge secondarily, and the rotary brush (430) located at the rear side of the sound wave generator (420) finally removes the unremoved sludge from the inner wall of the pipe, improving the removal efficiency of the sludge inside the pipe.

That is, as described above, the cleaning unit (400) is coupled to the driving unit (300) so that it can move and rotate in the forward and backward directions according to the operation of the driving unit (300). The cleaning unit can be driven to reciprocate in a certain section of the pipe according to the cumulative state of the sludge, removing the sludge repeatedly to clean the pipe.

So far the cleaning unit has been described in detail. In the following, the suction unit will be described in detail with reference to FIG. 4.

Figure 4:
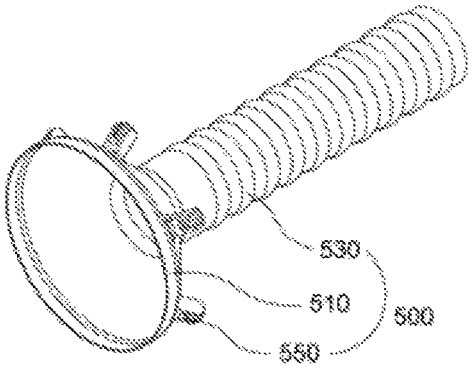
FIG. 4 is a perspective view of a suction unit according to an embodiment of the present invention.

FIG. 4 is a perspective view of a suction unit according to an embodiment of the present invention.

As shown in FIG. 4, the suction unit (500) is installed at a predetermined distance from the rear side of the cleaning unit (400) and is provided with a suction line (530) connected to a pump (not shown) to suck and discharge the sludge and foreign substance dispersed and removed by the cleaning unit. In detail, the suction unit comprises an inlet (510), a suction line (530) and a guide wheel (550).

First, the inlet (510) has upper and lower openings and is provided in a funnel shape with a diameter larger than the diameter of the frame (410), thereby sucking the sludge falling into the space to be collected in the inlet (510).

The suction line (530) is provided on the rear side of the inlet (510) in a bellows shape that can be contracted and relaxed in the longitudinal and circumferential directions with a plurality of wrinkles formed.

Particularly, the bellows shape can be changed by pneumatic pressure, and has an effect of transferring the inner sludge by its repetitive action of contraction and relaxation.

That is, one side of the suction line (530) is connected to a pump, an air circulation is formed in the suction line (530) at predetermined time intervals by the pump operation, and the suction line (530) is contracted and relaxed repeatedly by the air circulation to discharge the inner sludge to the outside.

Specifically, when air is supplied into the suction line (530), the suction line (530) contracts to narrow the inner diameter, and when the air is discharged, the suction line (530) is relaxed and restored to the original state. While this phenomenon is repeated at predetermined time intervals, the sludge accumulated in the suction line (530) may be discharged to the outside.

Accordingly, the present invention not only improves the suction ability but also does not require a high suction force due to an excellent energy consumption rate.

The guide wheel (550) is spaced apart in the circumferential direction along the outer circumferential surface of the inlet (510) and is provided in a plural number to provide smooth mobility when the suction unit (500) enters the pipe.

That is, the suction unit (500) is configured to suck the sludge falling into the space, collect the sludge in the inner space of the inlet (510), and discharge the sludge to the outside through the suction line (530) connected to the inlet (510). The above-described configuration not only improves the suction ability but also does not require a high suction force, so it is excellent in the energy consumption rate.

So far the configuration of a pipe cleaning robotic device for sludge removal and suction and discharge according to the present invention has been described.

Hereinafter, the operation of a pipe cleaning robotic device for sludge removal and suction and discharge equipped with the above-mentioned components will be described in detail with reference to FIG. 5 and FIG. 6.

Figure 5:
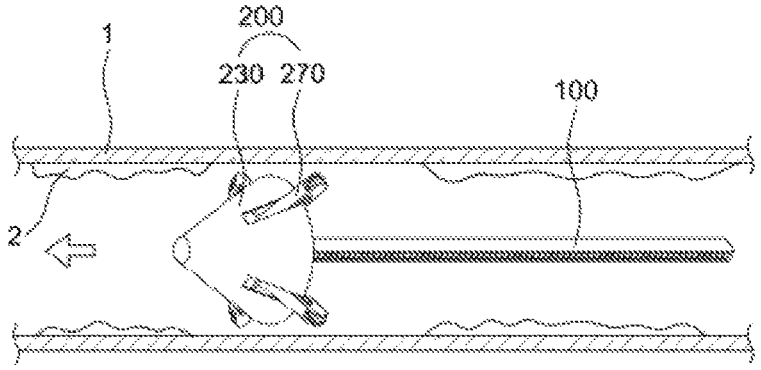
FIG. 5 is a view showing an operation state in which a rail and a fixed unit enter the pipe according to an embodiment of the present invention.
Figure 6:
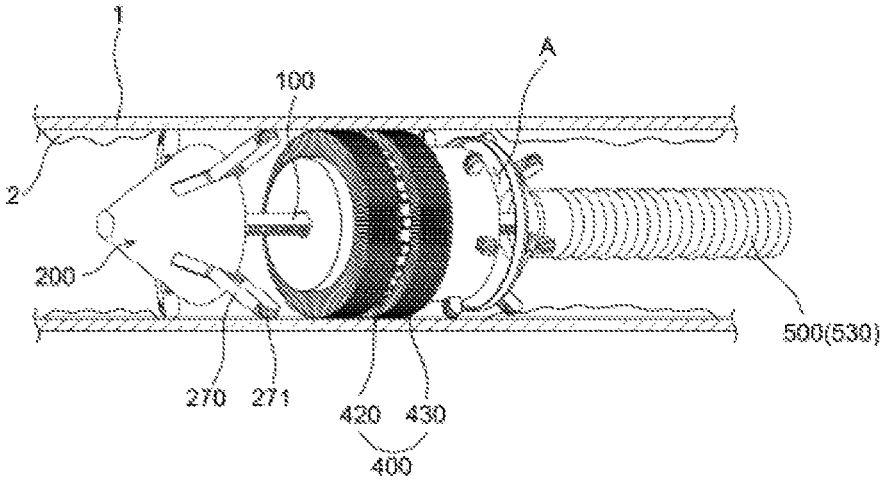
FIG. 6 is a view showing an operation state in a pipe of a clean robot device for sludge removal and suction and discharge according to an embodiment of the present invention.

FIG. 5 is a view showing an operation state in which a rail and a fixed unit enter the pipe according to an embodiment of the present invention, and FIG. 6 is a view showing an operation state in a pipe of a clean robot device for sludge removal and suction and discharge according to an embodiment of the present invention.

As shown in FIG. 5, when a pipe cleaning robotic device for sludge removal and suction and discharge according to the present invention removes the sludge (2) inside the pipe (1), the rail (100) and the fixed unit (200) first enter the pipe (1) which needs cleaning due to the sludge (2) fixed to the inner wall.

When the fixed unit (200) enters the pipe (1), as the end of the support (270) is projected outward of the head portion (210) to a minimum so as to be suitable for the state of the sludge (2) or the internal environment of the pipe (1) including the inside diameter and shape of the pipe (1), the fixed unit (200) can stably reach the forward target point while minimizing collision with the wall of the pipe (1) and being balanced by the deployment of the support (270).

Next, as shown in FIG. 6, when the fixed unit (200) reaches a target point in front inside of the pipe (1), an end of the support (270) protrudes to correspond to the inner diameter of the pipe (1) and a guide wheel (271) formed at an end of the support (270) is brought into close contact with the inner surface of the pipe (1) so that the fixed unit (200) can be firmly fixed to the inner wall of the pipe (1).

Then, a driving unit (300) and a cleaning unit (400) are mounted on the rail (100) and the cleaning unit (400) is moved into the pipe (1) along the rail (100) by the driving unit (300). The cleaning unit (400) is moved forward and backward along the rail (100) to be rotated and reciprocated within the pipe (1) so as to repeatedly remove the sludge (2) fixed inside the pipe (1).

More specifically, the cleaning unit (400) moves inside the pipe, generates a sound wave with a sound wave generator 420 to decompose the sludge on the inner wall of the pipe, and finally removes the decomposed sludge with a rotary brush (430).

In addition, the sludge (2), scattered by the cleaning unit (400), falls into a space (A) formed between the cleaning unit (400) and the suction unit (500) and is sucked through a suction line (530) connected to the pump and discharged to the outside.

The present invention has been described with reference to the embodiments shown in the drawings. It should be understood, however, that the present invention is not limited to the above-described embodiment, and that various modifications and equivalent embodiments are possible without departing from the scope of the present invention. Accordingly, the scope of the present invention should be determined by the following claims.

What is claimed is:

1. A pipe cleaning robotic device for sludge removal and suction and discharge, comprising:

a rail having a plurality of receiving grooves spaced at a predetermined distance on one side thereof;

a fixed unit formed at an end of the rail, inserted into a pipe, and fixed in contact with an inner peripheral surface of the pipe;

a driving unit mounted on the rail and movable in forward and backward directions along the rail by a wheel drive rotated by an external power;

a cylindrical frame for moving and rotating in the forward and backward directions according to driving of the wheel drive;

a cleaning unit comprising a sound wave generator and a rotary bush;

the sound wave generator is formed on one side of an outer circumferential surface of the frame to generate a sound wave to remove the sludge in the pipe;

the rotary brush is detachably formed on an other side of the outer circumferential surface of the frame and having an elastic material brush pin formed on the outer circumferential surface thereof;

the cleaning unit is mounted on a rear side of the fixed unit;

a funnel-shaped inlet having upper and lower openings, wherein a diameter of the upper opening is larger than a diameter of the frame;

a bellows-shaped suction line formed on a rear side of the funnel-shaped inlet; and a suction unit mounted on a rear side of the cleaning unit and spaced apart by a predetermined space, wherein the suction unit sucks the sludge falling into the space and collects the sludge in an inner space of the inlet, and discharges the sludge outside through the suction line connected to the funnel-shaped inlet.

2. The pipe cleaning robotic device according to claim 1, wherein the fixed unit comprises:

a head portion having a plurality of through-grooves formed at a front side thereof and spaced apart from each other by a predetermined distance;

a cover housed in an inner space of the head portion and coupled to a push rod horizontally movable forward and backward according to an air pressure;

a pressure control valve installed on the cover to regulate the air pressure in an internal space;

a plurality of supports inclined at an angle, each of the plurality of supports disposed radially above the cover for inserting one side thereof into each of the plurality of through-grooves; and a guide wheel formed at an end of the plurality of supports.

3. The pipe cleaning robotic device according to claim 1, wherein the driving unit comprises:

a wheel drive including a worm wheel and a worm shaft engaged with the worm wheel and configured to be rotated by an external power;

a forward drive mounted on the worm wheel, the forward drive rotates according to a rotation of the worm wheel, with a gear engaged with the plurality of receiving grooves during rotation, and the forward drive is configured to move in the forward and backward directions of the rail depending on a rotation direction; and a rotation drive mounted on one side of the worm shaft and rotating according to a rotation of the worm shaft, wherein an internal gear formed on one side of an inner circumferential surface of the frame rotates while being engaged with a gear formed on the rotation drive.

4. The pipe cleaning robotic device according to claim 1, wherein the inlet and the frame are provided with a plurality of guide wheels spaced apart in a circumferential direction along the outer circumferential surface of the frame.

* * * * *